US010605417B2

(12) United States Patent
Windom et al.

(10) Patent No.: US 10,605,417 B2
(45) Date of Patent: Mar. 31, 2020

(54) MULTI-FUNCTION FOCUSING FLASHLIGHT

(71) Applicant: COAST CUTLERY CO., Portland, OR (US)

(72) Inventors: Gregory David Windom, Portland, OR (US); Hai Rong Shi, Yangjiang (CN); Chao Jun Ding, Yangjiang (CN)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 16/189,965

(22) Filed: Nov. 13, 2018

(65) Prior Publication Data

US 2019/0145588 A1 May 16, 2019

Related U.S. Application Data

(60) Provisional application No. 62/586,708, filed on Nov. 15, 2017.

(51) Int. Cl.

| | |
|---|---|
| ***F21L 4/02*** | (2006.01) |
| ***F21V 5/04*** | (2006.01) |
| ***F21V 14/06*** | (2006.01) |
| ***F21V 23/00*** | (2015.01) |
| ***F21V 5/00*** | (2018.01) |
| ***F21V 23/04*** | (2006.01) |
| ***F21S 10/02*** | (2006.01) |
| *F21Y 115/10* | (2016.01) |
| *F21Y 113/13* | (2016.01) |

(52) U.S. Cl.

CPC ..... *F21L 4/027* (2013.01); *F21L 4/025* (2013.01); *F21S 10/023* (2013.01); *F21V 5/006* (2013.01); *F21V 5/04* (2013.01); *F21V 5/046* (2013.01); *F21V 14/065* (2013.01); *F21V 23/003* (2013.01); *F21V 23/0414* (2013.01); *F21V 23/0428* (2013.01); *F21Y 2113/13* (2016.08); *F21Y 2115/10* (2016.08)

(58) Field of Classification Search

CPC ..... F21L 4/027; F21L 4/025; F21V 5/046; F21V 14/065; F21V 23/003; F21V 5/006; F21V 23/0414

See application file for complete search history.

(56) References Cited

U.S. PATENT DOCUMENTS

| | | | | |
|---|---|---|---|---|
| 8,985,791 | B1 | 3/2015 | Hinzmann | |
| 10,234,082 | B1 * | 3/2019 | Diederich | F21L 4/027 |

(Continued)

FOREIGN PATENT DOCUMENTS

| | | | |
|---|---|---|---|
| EP | 3181989 | A1 | 6/2017 |
| WO | WO2004003428 | A1 | 1/2004 |

(Continued)

*Primary Examiner* — Anh T Mai
*Assistant Examiner* — Michael Chiang
(74) *Attorney, Agent, or Firm* — Schwabe Williamson & Wyatt, P.C.

(57) ABSTRACT

A multi-function flashlight that includes a flashlight body, an optic having a focusing portion and a non-focusing portion, a main LED positioned to direct light through the focusing portion, and one or more additional LEDs positioned to direct light through the non-focusing portion. A power source may be disposed within the flashlight body adapted to provide power to the main and additional LEDs, and a first control may be included that is configured to selectively provide power to the primary LED.

11 Claims, 4 Drawing Sheets

(56) References Cited

U.S. PATENT DOCUMENTS

| | | | | |
|---|---|---|---|---|
| 2005/0122711 | A1* | 6/2005 | Matthews | F21L 4/027 362/184 |
| 2005/0122712 | A1* | 6/2005 | Kim | F21L 4/027 362/184 |
| 2005/0157492 | A1* | 7/2005 | Chiu | F21L 4/027 362/184 |
| 2006/0087842 | A1* | 4/2006 | Alessio | F21L 14/00 362/235 |
| 2010/0091485 | A1* | 4/2010 | Matthews | F21L 4/027 362/234 |
| 2010/0231142 | A1* | 9/2010 | Yoon | F21L 4/027 315/312 |
| 2011/0080725 | A1* | 4/2011 | Brands | F21V 5/006 362/187 |
| 2011/0080736 | A1 | 4/2011 | Brands | |
| 2015/0077987 | A1* | 3/2015 | Zhang | G02B 19/0028 362/235 |
| 2016/0033107 | A1* | 2/2016 | Windom | F21L 4/027 362/184 |

FOREIGN PATENT DOCUMENTS

| | | | |
|---|---|---|---|
| WO | WO2013104878 | A1 | 7/2013 |
| WO | WO2014108662 | A1 | 7/2014 |
| WO | WO2016019162 | A1 | 2/2016 |

* cited by examiner

MULTI-FUNCTION FOCUSING FLASHLIGHT

CROSS-REFERENCE TO RELATED APPLICATIONS

This application claims priority to U.S. Provisional Patent Application No. 62/586,708, filed on Nov. 15, 2017, entitled "Multi-Function Focusing Flashlight," the disclosure of which is incorporated herein.

TECHNICAL FIELD

Embodiments relate to flashlights that emit beams that can be focused while also performing additional functions.

BACKGROUND

Focusing flashlights typically allow adjustment of a primary light beam in a continuous range of beam widths and/or focal distances ranging from a flood beam to a narrow beam, and vice versa. However, such systems become more complex when additional light sources, such as light sources that perform additional functions, are incorporated. For instance, the ability to focus the primary beam may be compromised by the inclusion of additional light sources, and/or the size of the flashlight may compromise usability.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
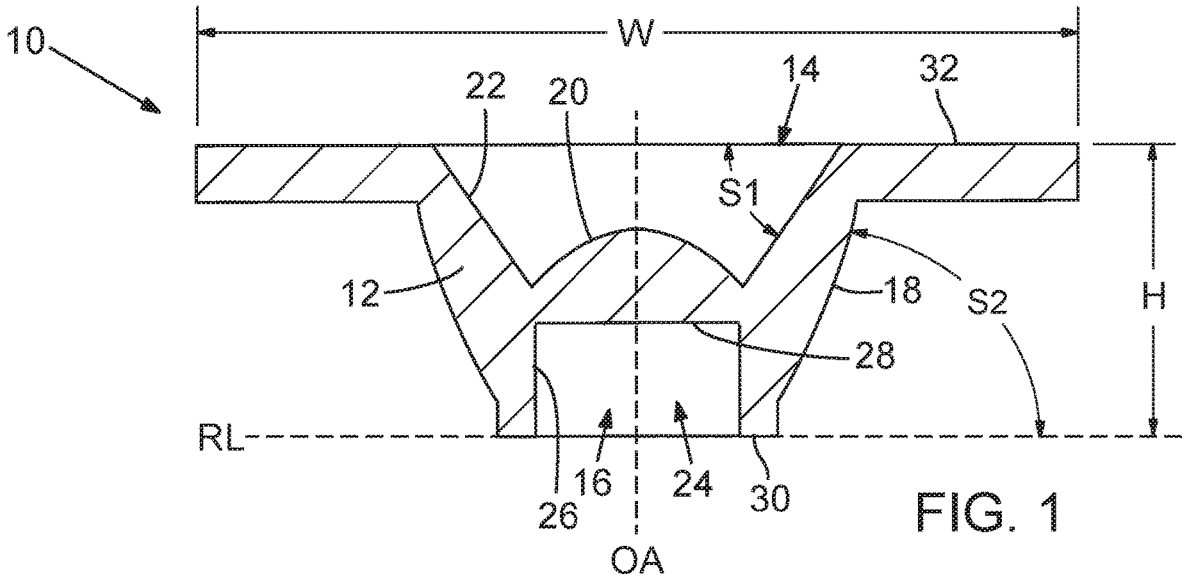
FIG. 1 is a side elevation sectional view of a first embodiment of a lens that may be used with an embodiment of the flashlight described herein.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide flashlights and other illumination devices that combine a bright primary beam that is focusable with one or more other LEDs that perform additional functions. In various embodiments, the focus of the primary beam may be changed from a spot light to a flood light (or vice versa) without altering the focus or function of the other LEDs.

In various embodiments, the illumination systems disclosed herein may include a focusing optic having a focusing portion that is aligned with a high powered LED, and a non-focusing portion that accommodates and protects any number of other LEDs that provide one or more additional functions. In various embodiments, the non-focusing portion of the optic may be substantially flat, such that the beam(s) emitted by the other LED(s) is/are not focused by the optic. Thus, in various embodiments, a single optic may provide both focusing and non-focusing functions, and changing the distance between the optic and the LEDs changes the focus of the primary beam without altering the focus of the other LED(s) beam(s).

In some embodiments, the focusing portion of the optic may be substantially central, with the non-focusing portion of the optic disposed substantially around the periphery of the optic. For example, in some embodiments, the optic may include a flat plane around the perimeter of the focusing portion, with a bright primary LED positioned substantially in the center, beneath the focusing portion of the optic, and with the other LED(s) positioned about the periphery, beneath the non-focusing portion of the optic. Although this configuration is illustrated in the accompanying figures, other arrangements are contemplated, such as positioning the focusing portion of the optic and the non-focusing portion of the optic side by side or one above the other.

In various embodiments, the light source for the primary beam may be a high intensity LED. The additional LED(s) may include any combination of colored LEDs (such as red, green blue, etc.), ultraviolet (UV) LEDs, infrared (IR) LED's, etc., which may be used for various specialty applications. For instance, red LEDs may be used for ambient illumination in low light conditions wherein a bright, white light might be unsuitable, such as for use during photography or astronomy applications. In other embodiments, different colored LEDs may be used for signaling applications. In some embodiments, the additional LEDs may be clustered together or may be segregated by color or functions. In some embodiments, the additional LEDs may be separately actuatable by color or by function, and may be operated by themselves or together with the primary beam.

In various embodiments, both the primary LED and the additional LED(s) may be fixed in position with respect to the flashlight body, and the distance between the LEDS and the optic may be adjusted in order to focus the primary beam. In various embodiments, the distance between the optic and the LED may be adjusted using any of many different mechanisms such as sliding the optic (and/or the bezel carrying the optic) toward or away from the LEDs, or by rotating the optic (and/or the bezel carrying the optic) along a threaded coupling mechanism. In various embodiments, by allowing the optic to be moved independently of the additional LED(s), the system avoids the requirement for flexible electrical couplings supplying power to the additional LEDs, resulting in a cheaper and more robust system.

Focusing optics can take any of several different forms, and thus the focusing portion of the optics disclosed herein may have any form that is compatible with the non-focusing portion of the optic, and that can change the focus of a high-intensity beam from a flood beam to a spot beam (and vice versa) when the distance between the optic and the LED is changed. For example, in some embodiments, the focusing portion of the optic may include a convex front surface and a rear void for receiving the primary LED, such as the optics depicted in U.S. Pat. Nos. 8,152,327 and 8,371,710, both of which are incorporated by reference. In other embodiments, the focusing portion of the optic may have a thin profile, such as the optics disclosed in U.S. Pat. No. 9,416,937, which is incorporated by reference herein.

In various embodiments, the systems disclosed herein also may include a power source disposed within the housing member and adapted to provide power to the primary and other LEDs, and a control element configured to selectively provide power to the primary LED and/or other LEDs. For example, the control element may cause the primary LED to be illuminated, and/or it may cause one or more of the other LEDs to be illuminated, and/or it may cause a subset of the other LEDs to be illuminated, or it may cause the primary LED and one or more of the other LEDs, or a subset of the other LEDs to be illuminated.

A multi-function flashlight that includes a flashlight body, an optic having a focusing portion and a non-focusing portion, a main LED positioned to direct light through the focusing portion, and one or more additional LEDs positioned to direct light through the non-focusing portion. A power source may be disposed within the flashlight body adapted to provide power to the main and additional LEDs, and a first control may be included that is configured to selectively provide power to the primary LED.

Another aspect of the disclosure is a multi-function flashlight having a flashlight body, a main LED for generating a main beam, and one or more additional LEDs for generating one or more additional beams. An optic for the flashlight includes a lens having a convex central surface disposed over the main LED, and a planar peripheral surface disposed over the additional LEDs. A control may be provided for adjusting the main beam between broad and narrow beams, the control comprising a bezel that is forwardly and rearwardly slidably mounted to a front portion of the flashlight body, wherein the optic is disposed in the bezel, and the main LED is mounted to the flashlight body so that sliding the bezel forwardly and rearwardly moves the optic away from and toward the main LED, thereby narrowing and broadening the main beam, respectively. The bezel is rotatably mounted to the flashlight body, and rotation of the bezel with respect to the flashlight body shifts power selectively between the additional LEDs.

Yet another aspect of the disclosure is a lens for a multi-function flashlight. The lens includes an annular lens body designed to fit into a bezel of a flashlight, the annular lens body comprising a convex central surface to be disposed over a main LED, and a planar peripheral surface to be disposed over additional LEDs. The lens body further defines a frusto-conical surface extending between the convex central surface and the planar peripheral surface. A cylindrical well is disposed directly under the convex central surface, for selectively receiving the main LED.

Figure 2:
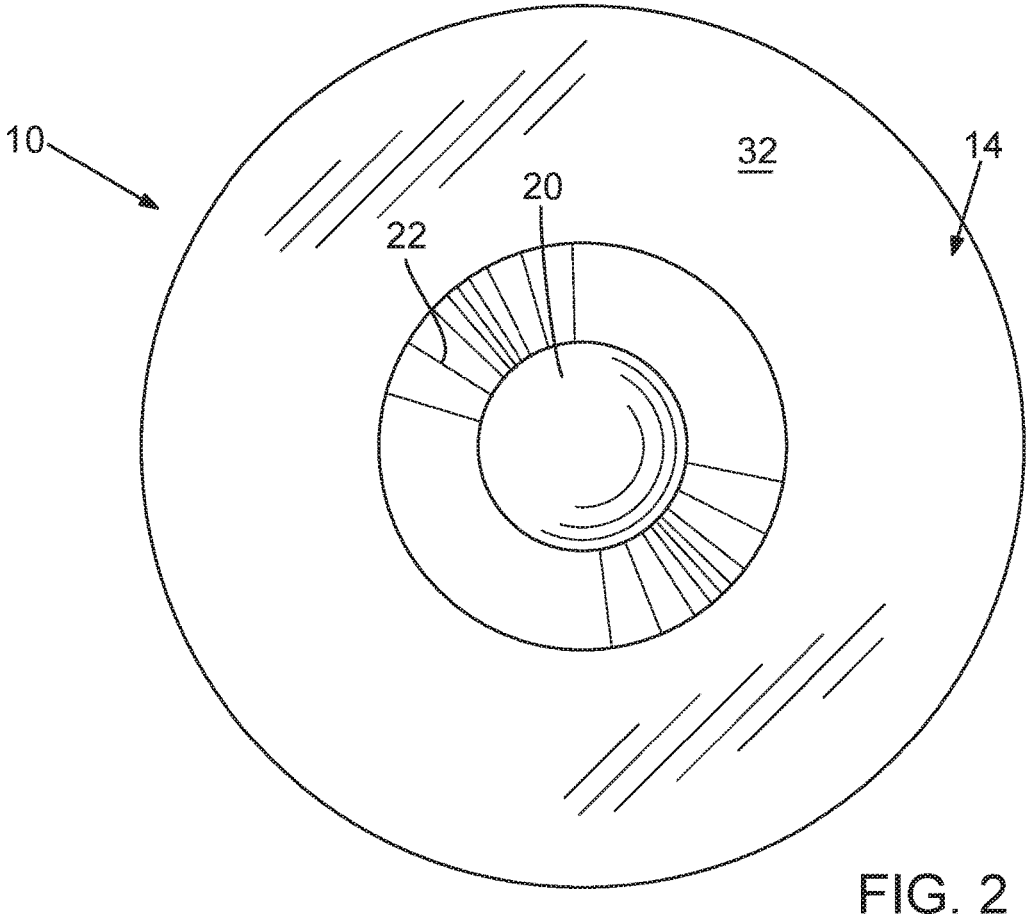
FIG. 2 is a front end view of the lens of FIG. 1.
Figure 5:
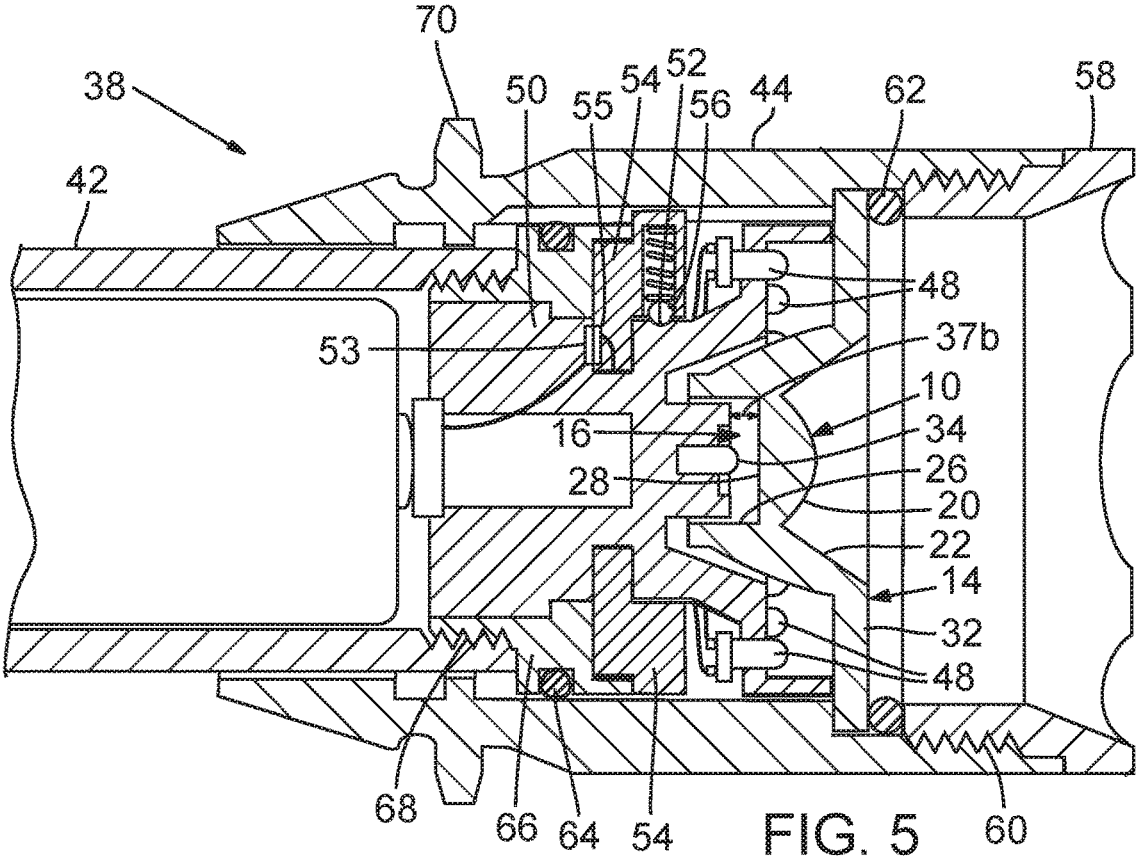
FIG. 5 is a side elevation sectional view of the embodiment of the flashlight of FIG. 3, with the bezel in its rearward-most position so the optic is close to the main LED.
Figure 6:
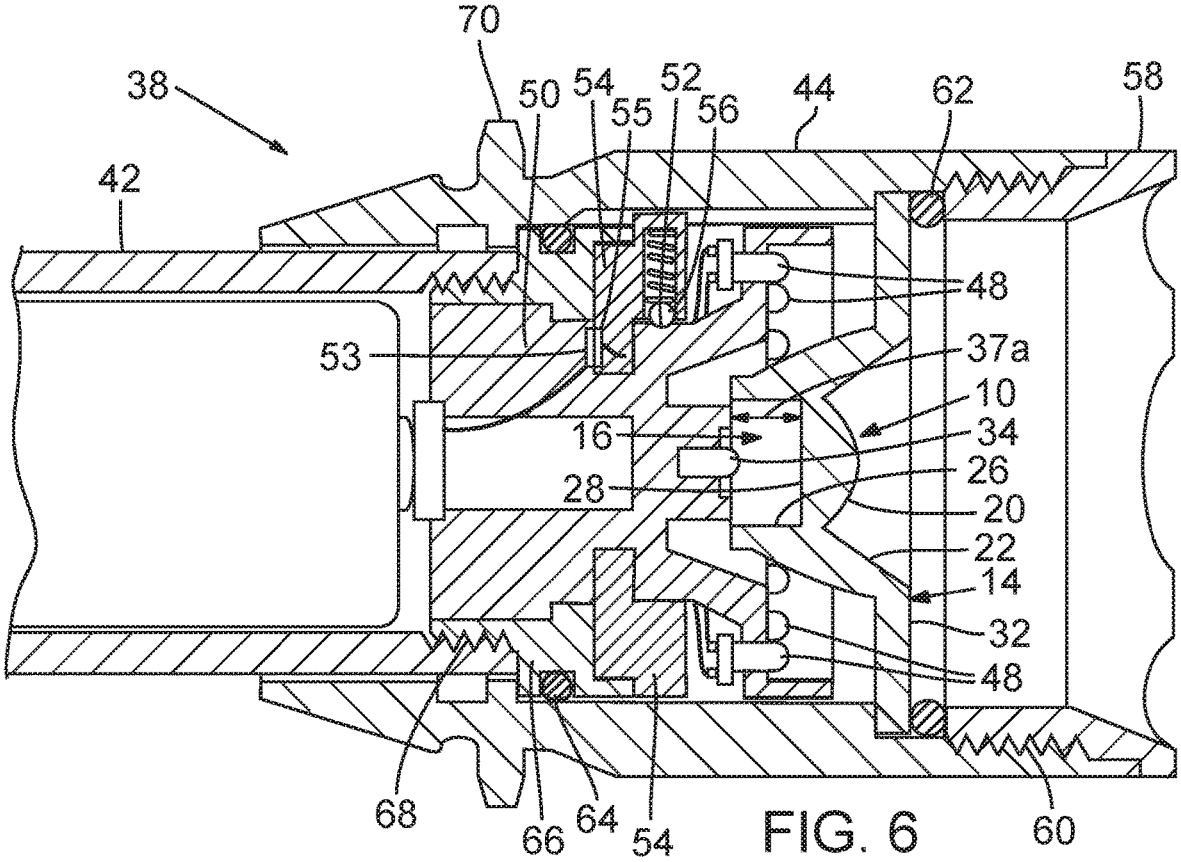
FIG. 6 is a side elevation sectional view of the embodiment of the flashlight of FIG. 3, with the bezel in its forward-most position so the optic is spaced from the main LED.

FIGS. 1 and 2 show a lens 10 for focusing light. Lens 10 may include a lens body 12 with a front face 14, a rear void, such as well 16, and a side surface 18 that extends between front face 14 and rear well 16. Front face 14 may include a central surface 20 surrounded by a frusto-conical surface 22 that may define a portion of a cone. Front face 14 may also include a planar, peripheral face 32. Rear well 16 defines a space 24 within which a main LED or other light source may be positioned for rearward and forward adjustment (FIGS. 5 and 6, respectively).

Well 16 is typically defined by a sidewall 26 and a base 28. Space 24 defined by sidewall 26 preferably is in the configuration of a cylindrical void. Central surface 20 typically defines in cross-section a convex curve. Rear well 16 may include a rear rim 30, which, may be understood to define a reference line RL.

The shape of the faces in lens body 12 may be any shape suitable for manufacture and use. Frusto-conical surface 22 may extend at a first angle 51 of about 45 degrees from peripheral face 32. Side surface 18 may extend at a somewhat steeper angle S2 from RL, here about 60 degrees. A typical radius for the convex central surface is about 7 mm.

The measurements of embodiments of the lens described herein are typical for a medium-sized lens system, such as one with an external diameter around the lens of about 1.25-inches. For smaller and larger lens systems, the measurements for the lens may be varied accordingly. As an example, lens 10 may, in a large lens system, be at least about twice as large as the typical measurements provided herein.

Lens 10 defines a width W that is the outer diameter at peripheral face 32 and a height H between rear rim 30 and the peripheral face. Typically width W is between about 20-mm and about 50-mm. Rear well 16 typically has an inner diameter of at least about 5-mm. Rear well 16 may have an inner diameter selected for a desired lens size and operational characteristics. Rear well 16 may be provided adjacent rear rim 30 with a draft angle of between about 2 degrees and about 3 degrees to ease removal of the mold parts from around the rear well.

As seen in FIGS. 5 and 6, a light source, such as LED 34, is preferably fixed in position along an optical axis OA (see FIG. 1), generally within rear well 16. A bezel 36 typically is permitted to slide from a typical starting position shown in FIG. 5 to a forward position shown in FIG. 6. The sliding is indicated schematically at 47 in FIGS. 3, 7 and 8. The difference in the forward and rearward positions of bezel 44 lengthens and shortens the gap between the bezel and the top of the flashlight body. The gap is shown schematically in FIGS. 5 -8, with the bezel in its forward position showing a large gap at 37*a* and in its rearward position showing a small gap at 37*b*. The adjustment of bezel 36 may be continuous or it may be provided with stops or detents at selected positions. Any range of position adjustments may be incorporated as suited to the particular lens size, design, and desired beam variations. As bezel 36 is moved forward and rearward, the distance between main LED 34 and lens body 12 or specifically base 28 is increased and decreased. Typically the range of movement is about 4-mm to about 8-mm. Main LED 34 typically is disposed approximately even with reference line RL at its rearmost position, or may start within rear well 16 above reference line RL or below reference line RL. Given that rear well 16 is about 9-mm deep. Main LED 34 may be movable forward within the well to within about 2-mm to 6-mm of base 28, or to other limits as selected for desired operational characteristics of the lens system.

Adjustment of the lens position relative to the position of the main LED provides a beam ranging between a wide beam and a narrow or spot beam. When lens 10 is in the rearward-most position shown in FIG. 5, a flood focus may be provided. When lens 10 is forward of that position, such as in the forward-most position shown in FIG. 6, a spot focus may be provided. Focuses between flood and spot are provided when lens 10 is in positions between rearward and forward positions. A spot beam may provide about +/−4.3.degrees of angular distribution at about 50% of maximum intensity. An example of a wide beam is about +/−20.degrees of angular distribution at about 50% of maximum intensity. With the design of the present embodiment, the light may be varied from spot beam to wide beam with the adjustment in position of the main LED 34 being no more than about 5-mm. Lens 10 typically directs a substantial portion of light rays LR into the desired beam and a smaller portion of light rays LR may be expected to travel outside the desired beam.

Lens 10 for focusing a light beam may be mounted in a flashlight such as that shown generally at 38 in FIGS. 3, 4, 7 and 8. Flashlight 38 may include a flashlight body 42 with an adjustable bezel 44. As explained earlier, lens 10 may be forwardly and rearwardly adjustable, and this is done with the axially-adjustable bezel 44. This forward and rearward adjustability may also be provided with a threaded engagement to more closely control the forward and rearward adjustability but that feature is not included in the depicted embodiment.

Figure 3:
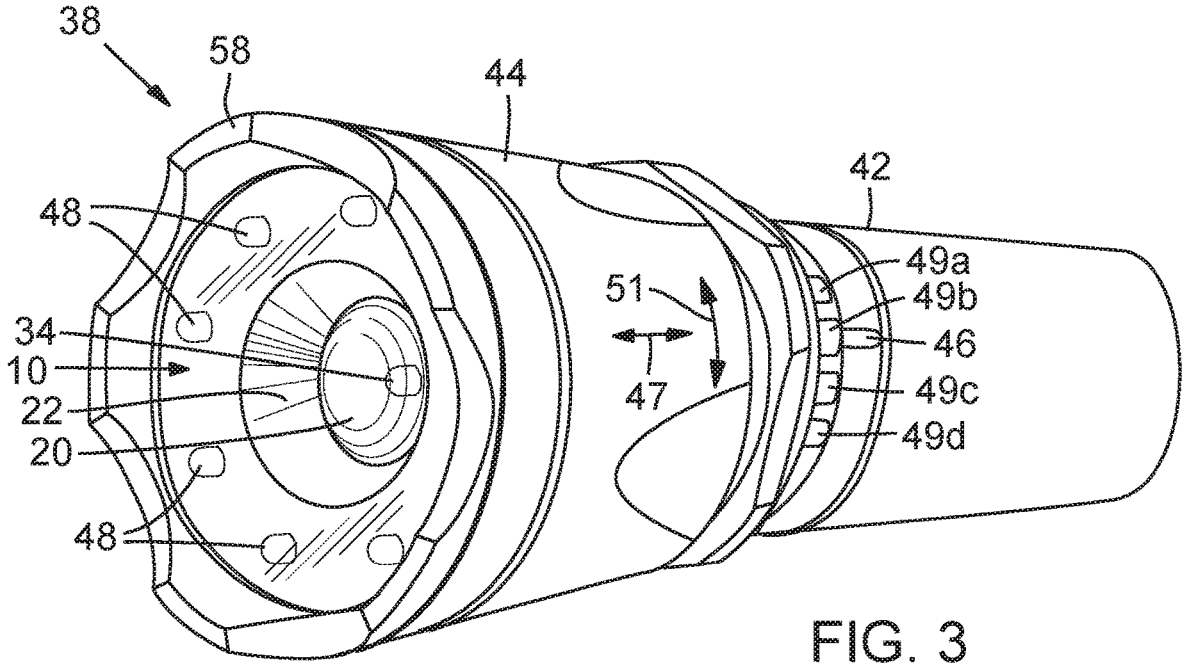
FIG. 3 is a perspective of a first embodiment of a flashlight, taken from a front angle showing the rotatability and slidability of the depicted embodiment.
Figure 4:
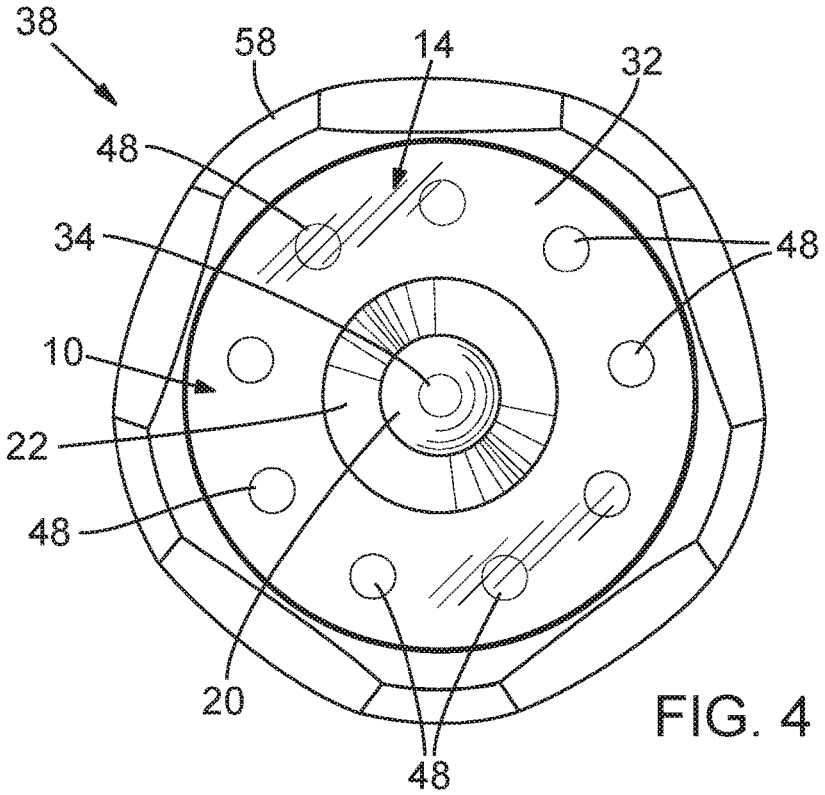
FIG. 4 is a front end view of the embodiment of the flashlight of FIG. 3.
Figure 7:
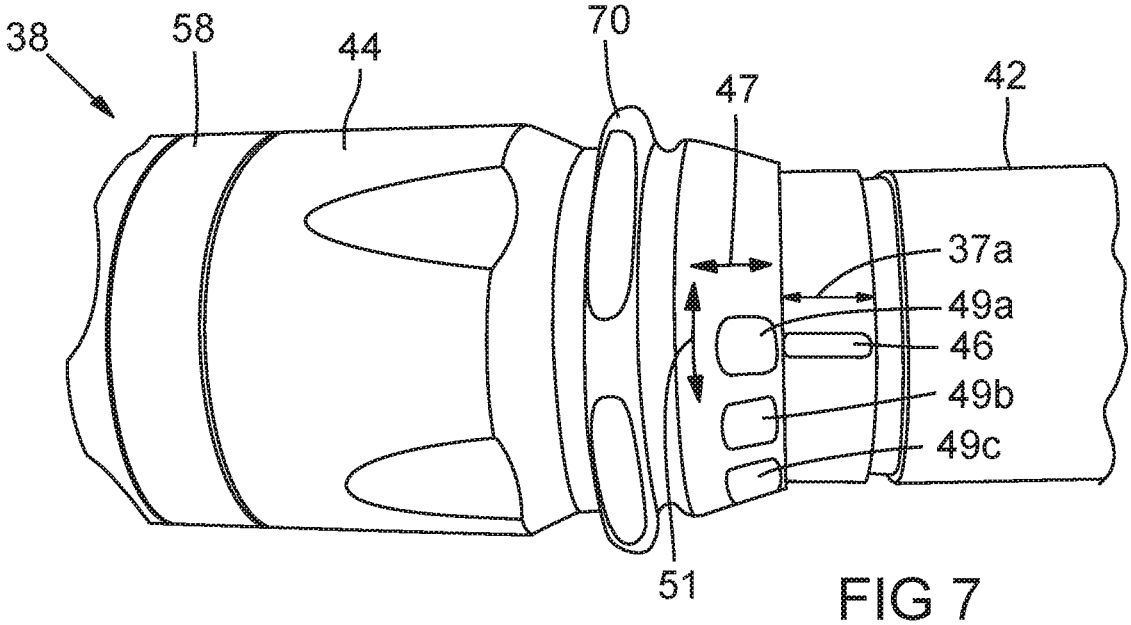
FIG. 7 is a perspective view of the flashlight of FIG. 3 with the bezel slid to its forward-most position corresponding to FIG. 6.
Figure 8:
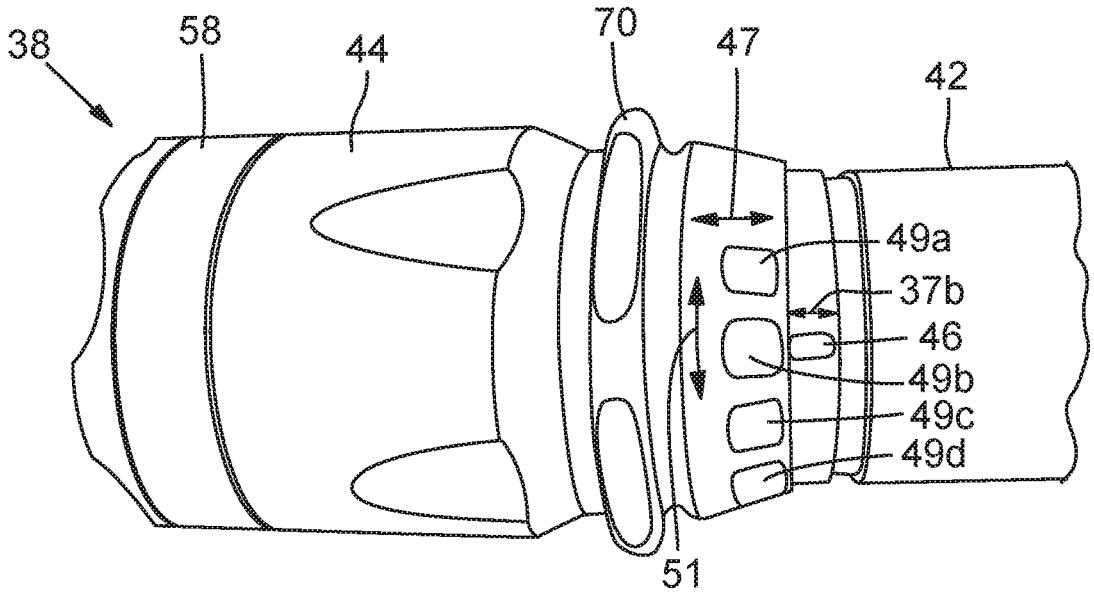
FIG. 8 is a perspective view of the flashlight of FIG. 3 with the bezel slid to its rearward-most position corresponding to FIG. 5.

In the depicted embodiment, bezel 44 may also be rotatably adjustable to activate additional LEDs 48 (see 51 in FIGS. 3, 7 and 8). These additional LEDs 48 provide the different colors or different types of light, such as UV or IR. In the depicted embodiment, an indicator line 46 may be turned to different indicators 49*a-d* that may be colored the same as the other LED to which they correspond.

In the preferred embodiment the focus of the additional LEDs 48 may vary between the forward and rearward position of bezel 36 but will not be nearly as pronounced as the focus of adjustment of main LED 34. The difference in focus between the main LED 34 and the additional LEDs 48 may be described herein as the other LEDs not being focusable.

As shown in FIGS. 5 and 6, main LED 34 and additional LEDs may be mounted in an LED housing 50. Main LED 34 is centrally mounted in LED housing 50, while additional LEDs 48 are peripherally mounted to a forward portion of the housing.

As noted above, rotation of bezel 36 may cause different ones of the additional LEDs 48 to be activated. As shown in FIG. 3, the user may select the color or type of light that is desired by viewing the exterior of bezel 36. As the bezel is rotated between, say, the positions of FIGS. 7 and 8, different additional LEDs are activated. This rotation feature may also include an OFF position or an ON/OFF switch may be included at the rear end of the flashlight or elsewhere on the flashlight.

This rotation of bezel 36 may be free without any increments or detents to cause incremental rotation but it is preferred that detents be provided to ensure that the desired color or type of light is activated. A detent system is provided by a spring-loaded detent ball 52 disposed in a detent housing 54, and complementing detent depression 56 in LED housing 50. One such detent depression 56 is shown in FIGS. 5 and 6 but it should be understood that there may typically be as many detent depressions as there are different additional LEDs 48. Contacts 53 and 55 permit detent housing 54 and LED housing to be rotated with respect to each other while maintaining electrical contact.

The rest of flashlight 38 may be conventional in design, with a bezel cap 58 mounted by threads 60 to bezel 36. A transparent, protective cover (not shown may be disposed in the bezel cap. An O-ring 62 may be mounted below bezel cap 58 to minimize the likelihood that debris or moisture will enter the bezel. Another O-ring 64 may be disposed in the lower part of bezel 36 in a mounting body 66 to which flashlight body 42 is mounted by threads 68. This facilitates removal of the bezel for replacement of batteries (not shown) typically mounted in flashlight body 42. Depending on the conditions in which the flashlight will be operated, the batteries may be rechargeable or not.

The outer portion of bezel 36 typically includes an annular ring 70 to facilitate the rotation and axial adjustment of the bezel with respect to the flashlight body. In the depicted embodiment, annular ring has flattened portions so adjustment of the bezel may be accomplished even with the operator wearing heavy gloves or if the bezel is wet or slippery. The flashlight may be made from a metal such as aluminum or steel or a plastic such as ABS. Component materials may be selected to be compatible with lighting unit operation in harsh environments such as very high or very low ambient temperatures.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A multi-function flashlight, comprising:

a flashlight body;

an optic having a focusing portion and a non-focusing portion;

a main LED positioned to direct light through the focusing portion;

one or more additional LEDs positioned to direct light through the non-focusing portion;

a power source disposed within the flashlight body adapted to provide power to the main and additional LEDs; and a first control configured to selectively provide power to the primary LED;

wherein the optic includes a lens having a convex central surface disposed over the main LED, a substantially planar peripheral surface disposed over the additional LEDs, and a frusto-conical portion extending between the convex central surface and the planar peripheral surface.

2. The flashlight of claim 1 wherein the lens further comprises a cylindrical well disposed directly under the convex central surface, for selectively receiving the main LED.

3. A multi-function flashlight, comprising:

a flashlight body;

a main LED for generating a main beam;

one or more additional LEDs for generating one or more additional beams;

an optic including a lens having a convex central surface disposed over the main LED, and a planar peripheral surface disposed over the additional LEDs;

further comprising a control for adjusting the main beam between broad and narrow beams, the control comprising a bezel that is forwardly and rearwardly slidably mounted to a front portion of the flashlight body, wherein the optic is disposed in the bezel, and the main LED is mounted to the flashlight body so that sliding the bezel forwardly and rearwardly moves the optic away from and toward the main LED, thereby narrowing and broadening the main beam, respectively; and wherein the bezel that is rotatably mounted to the flashlight body, and rotation of the bezel with respect to the flashlight body shifts power selectively between the additional LEDs.

4. The flashlight of claim 3 wherein the lens includes a frusto-conical portion extending between the convex central surface and the planar peripheral surface.

5. The flashlight of claim 3, wherein the additional LEDs provide beams in a variety of colors, and the flashlight body and bezel include an indicator and indicator panels that correspond in color to the color of the additional beams.

6. The flashlight of claim 3, wherein the additional LEDs provide infrared and/or ultraviolet lighting.

7. A multi-function flashlight having a lens comprising:

an annular lens body designed to fit into a bezel of the flashlight;

a main LED positioned within the annular lens body;

additional LEDs disposed radially outwardly from the main LED;

the annular lens body comprising a convex central surface to be disposed over the main LED so the main LED shines through the central surface, and a planar peripheral surface to be disposed over the additional LEDs so the additional LEDs shine through the planar peripheral surface; and the lens body further defining a frusto-conical surface extending between the convex central surface and the planar peripheral surface.

8. The lens of claim 7, further comprising a cylindrical well disposed directly under the convex central surface, for selectively receiving the main LED.

9. A multi-function flashlight, comprising: a flashlight body;

an optic having a focusing portion and a non-focusing portion;

a main LED positioned to direct light through the focusing portion; and one or more additional LEDs positioned to direct light through the non-focusing portion, wherein the optic includes a substantially planar peripheral surface disposed over the additional LEDs; and a first control configured to selectively provide power to the primary LED;

wherein the optic includes a lens having a convex central surface disposed over the main LED, a substantially planar peripheral surface disposed over the additional LEDs, and a frusto-conical portion extending between the convex central surface and the planar peripheral surface.

10. The multi-function flashlight of claim 9, wherein the optic includes a lens having a convex central surface disposed over the main LED.

11. The multi-function flashlight of claim 9, wherein the optic includes a frusto-conical portion extending between the convex central surface and the planar peripheral surface.

* * * * *